United States Patent [19]

Sugiura et al.

[11] Patent Number: 4,818,458

[45] Date of Patent: Apr. 4, 1989

[54] METHOD OF PRODUCING ACRYLIC FIBERS

[75] Inventors: Akira Sugiura; Shigeru Sawanishi; Noboru Ogawa, all of Okayama, Japan

[73] Assignee: Japan Exlan Company Limited, Osaka, Japan

[21] Appl. No.: 926,625

[22] Filed: Nov. 4, 1986

[30] Foreign Application Priority Data

Nov. 26, 1985 [JP] Japan ..... 60-266741

[51] Int. Cl.[4] ..... D01F 6/18

[52] U.S. Cl. ..... 264/182; 264/206; 264/210.8; 264/211.14; 264/211.15

[58] Field of Search ..... 425/382.2, 66, 67, 68, 425/70, 725, 464; 264/182, 206, 176.1, 210.8, 211.14, 211.15

[56] References Cited

U.S. PATENT DOCUMENTS

| | | | |
|---|---|---|---|
| 2,447,994 | 8/1948 | Wicker | 425/464 |
| 2,703,433 | 3/1955 | Holtzmann | 425/464 |
| 2,736,920 | 3/1956 | Wicker | 425/464 |
| 2,798,252 | 7/1957 | Cummings, Jr. | 425/464 |
| 2,957,748 | 10/1960 | Lieseberg | 264/206 |
| 3,088,793 | 5/1963 | Knudsen et al. | 264/206 |
| 3,412,191 | 11/1968 | Kitajima et al. | 264/182 |
| 3,558,761 | 1/1971 | Tabara et al. | 264/206 |
| 3,667,886 | 6/1972 | Gauthier et al. | 425/382.2 |

*Primary Examiner*—Jan H. Silbaugh
*Assistant Examiner*—Hubert C. Lorin
*Attorney, Agent, or Firm*—Wenderoth, Lind & Ponack

[57] ABSTRACT

A spinning solution of an acrylonitrile polymer is subjected to dry-wet spinning through an annular type spinneret having a non-perforated part, i.e. a part not formed with spinning orifices, extending from the outer periphery to the inner periphery. The spinneret has more than 3,000 spinning orifices, at the perforated part of the annular portion. The extruded fibers are then passed through a coagulation bath, and the coagulated fibers are then stretched. By this method, uniform acrylic fibers can be produced without causing quality unevenness and fiber defects due to uneven coagulation, filament agglutination, and fluctuation of the gap between spinneret lower surface and liquid surface of the coagulation bath.

1 Claim, No Drawings

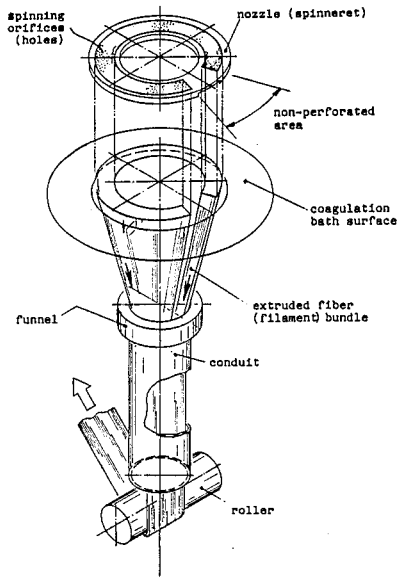

METHOD OF PRODUCING ACRYLIC FIBERS

BACKGROUND OF THE INVENTION (1) Field of the Invention

This invention relates to a method of producing acrylic fibers and more particularly to a method of producing acrylic fibers of uniform quality at high productivity by using a particular spinneret.

(2) Description of the Prior Art

Since acrylic fibers have a bulky touch resembling wool and excellent physical properties and dyeability, they are widely used in the field of clothing, bedding, etc. Continuous efforts are made toward the improvement of Productivity of the fibers.

A representative technique for such improvement of productivity is to increase the number of spinning orifices of the spinneret. When the orifice density is increased (i.e. when the orifice intervals are made small), single filaments agglutinate with one another, or when the size of the spinneret is enlarged, it is difficult for the coagulation liquid to penetrate into the inner part of the spun fiber bundle and this makes the coagulation uneven. Therefore, as a means for solving the problem of uneven coagulation which accompanies an increase of the orifice number, the use of annular type spinnerets has been proposed.

On the other hand, attempts have been made to improve the quality of the fibers and the to bestow new properties on the fibers. For example, the dry-wet spinning process (in which the spinning solution is once extruded into an inert gas and then introduced into the coagulation bath) described in Japanese Patent Publication No. 26212/1965 is known to provide acrylic fibers of dense fiber structure having a smooth surface and highly lustrous appearance and possessing excellent physical properties.

We investigated the effect of the conventional annular type spinnert. It became apparent that the coagulation liquid supplied from the outer peripheral side of the spinneret was not sufficiently supplied to the inner part of the spun fiber bundle, and that when the fiber bundle is gathered at the outlet of the coagulation bath, the coagulation liquid once supplied to the inner part of the fiber bundle has no way of escape, so that it circulates within the fiber bundle and puts the fiber bundle into disorder.

In the dry-wet spinning process, when using a spinneret having a small number of spinning orifices (up to 1,000 orifices at most) as in the case of producing filament yarn, it is possible to obtain fibers of excellent quality and performance as mentioned above, fairly without problems in operation. But with the increase of the number of orifices, it was found that the dry-wet spinning process causes the following various essential defects:

(i) The coagulation becomes uneven between the inner part and outer part of the spun fiber bundle;

(ii) The liquid filaments extruded from the spinneret (which do not substantially coagulate during the travel through the inert gas) easily agglutinate with one another by the contact between the filaments, and once they agglutinate, they do not separate easily;

(iii) The thicker the spun fiber bundle, the more liable is the coagulation liquid surface to be agitated. This causes fluctuation in the yarn quality.

(iv) Owing to the descending flow of the coagulation liquid accompanied by the spun fiber bundle, the coagulation liquid flows toward the central part of the fiber bundle. But with the increase of the number of spinning orifices, it becomes difficult for the coagulation liquid to be supplied to the inner part of the fiber bundle. Therefore, the liquid surface of the inner part of the fiber bundle becomes low, and at the same time the liquid surface of the outer part rises to a higher level, and thus the difference in the gap (distance between the spinneret surface and the coagulation liquid surface) among spinneret orifices becomes remakable. Or the spinneret may be dipped in the coagulation liquid, and consequently defective yarns such as thick-and-thin yarn, agglutinated yarn, abnormal denier yarn, etc. may increase markedly.

Taking into account the above-mentioned points which became clear from various experiments, we carried on studies of fiber production, and as a result, we reached this invention.

SUMMARY OF THE INVENTION

The object of this invention is to provide a method of producing acrylic fibers of uniform quality at high productivity, without problems of irregularity in quality and yarn defects resulting from uneven coagulation, agglutination, gap fluctuation, etc.

The above-mentioned object of this invention is attained advantageously in an industrial manner by spinning an acrylonitrile (hereinafter referred to as AN) polymer spinning solution through an annular type spinneret having a non-perforated part or parts extending from the outer periphery to the inner periphery and having more than 3,000 spinning orifices.

BRIEF DESCRIPTION OF THE DRAWING

The drawing is a perspective view of a spinning apparatus which can be used in the method of the present invention, showing an upwardly detached view of the spinneret with its non-perforated area.

DETAILED DESCRIPTION OF THE INVENTION

This invention will be explained in detail in the following:

First, the AN polymer as mentioned in this invention is composed singly of AN or composed of more than 50 weight % AN, preferably more than 75 weight % AN, and at least one other ethylenically unsaturated compound as the remainder. Among said other ethylenically unsaturated compounds may be mentioned known unsaturated compounds copolymerizable with AN, for example, vinyl halides and vinylidene halides such as vinyl chloride, vinyl bromide, vinyl fluoride, vinylidene chloride, etc.; (meth)allyl alcohol and ethers thereof; unsaturated carboxylic acids such as (meth)acrylic acid, maleic acid, itaconic acid, etc. and salts thereof; (meth-)acrylic acid esters such as methyl (meth)acrylate, ethyl (meth)acrylate, butyl (meth)acrylate, octyl (meth)acrylate, methoxyethyl (meth)acrylate, phenyl (meth)acrylate, cyclohexyl (meth)acrylate, etc.; unsaturated ketones such as methyl Vinyl ketone, phenyl vinyl ketone, etc.; vinyl esters such as vinyl formate, vinyl acetate, vinyl propionate, etc.; acrylamide and its alkyl substituted derivatives; N-methylol acrylamide; unsaturated hydrocarbon sulfonic acids such as vinylsulfonic acid, (meth)allylsulfonic acid, p-styrenesulfonic acid, etc. and salts thereof; 2-acrylamide-2-methylpropanesulfonic acid and salts thereof; (meth)acrylic acid sulfoalkyl ester such as sulfobutyl acrylate, sulfopropyl methacrylate, etc. and salts thereof; styrenes and alkyl or halogen substituted derivatives thereof such as styrene, α-methylstyrene, chlorostyrene, etc.; basic vinyl compounds such as vinylpyrydine, vinylimidazole, dimethylaminoethyl methacrylate, etc.; vinyl compounds such as (meth)acrolein, vinylidene cyanide, glycidyl (meth)acrylate, methacrylonitrile, etc.

Among the solvents that are used for the production of the spinning solution may be mentioned organic solvents such as dimethyl sulfoxide, dimethylformamide, dimethylacetamide, ethylene carbonate, etc.; concentrated aqueous solutions of thiocyanates such as sodium thiocyanate, potassium thiocyanate, ammonium thiocyanate, calcium thiocyanate, etc.; concentrated aqueous solutions of inorganic salts such as zinc chloride, lithium chloride, etc.; concentrated aqueous solutions of inorganic acids such as sulfuric acid, nitric acid, etc. However, it is desirable to employ inorganic solvents from the viewpoint of the uniformity of coagulation, etc.

It is desirable that the viscosity of the spinning solution should be suitably determined within the known range, or in the case of employing the dry-wet spinning process in which the effect of this invention can be better displayed, it is desirable that it should be determined within the range of from 1,000 to 20,000 poises at 30° C., preferably from 3,000 to 10,000 poises. When it is lower than the lower limit, there are problems such as breakage of the spun filaments or uneven quality. When it exceeds the upper limit, there are problems in spinning operation.

As for the spinneret which constitutes the central requirement of this invention, it is necessary to use one that is of annular form and has a non-perforated part or parts extending from the outer periphery to the inner periphery. Only by using such a spinneret, even if the number of spinning orifices is increased to above 3,000 or preferably to above 5,000, is it possible to eliminate all such problems as uneven coagulation between the inner part and outer part of the spun fiber bundle, or uneven quality or yarn defects caused by said uneven coagulation.

The annular form is not always necessary to be a true circle, and also the non-perforated part may be of any shape as long as the coagulation liquid can be supplied from the outer side of the spun fiber bundle toward the inner side (central part). Furthermore, such non-perforated part may be formed at plural places, but the coagulation liquid flowing from plural places to the inner part of the fiber bundle may collide and disturb the liquid flow to bring about denier fluctuation. Therefore, it is desirable that there by one non-perforated part.

As for the area ratio of the non-perforated part, it is desirable that it is in the range of 1/12–¼, preferably 1/9–1/5 based on the whole spinneret area that can be perforated. When the area ratio is lower than the lower limit, the quantity of the coagulation liquid supplied to the inner part of the spun fiber bundle becomes insufficient, and if it exceeds the upper limit, the perforated area becomes smaller, so that it becomes impossible to attain the purpose of increasing the number of spinning orifices. In the case of employing the dry-wet spinning process, when the non-perforated part is cut away from the spinneret surface, the distance between the non-perforated part below which the coagulation liquid flows into the inside of the spun fiber bundle and the coagulation liquid surface can be enlarged. Consequently, the immersion of the spinneret caused by the rise of the liquid surface due to the inflow of the coagulation liquid can be prevented effectively.

By determining the width of the annulus and the interval between the spinning orifices so as to satisfy the following formula (IV), the spinneret can favorably decrease the inflow resistance of the spun fiber bundle into the coagulation liquid and can control the fluctuation of the liquid surface:

$$W/p > 100 \quad \text{(IV)}$$

wherein W represents the width of the annulus and p represents the interval between the spinning orifices.

As for the gap upon employing the dry-wet spinning process, a gap generally within the range of from 1 to 20 mm gives good results in both operability and quality.

In the case of employing the dry-wet spinning process, when the following conditions are satisfied, the quality and operability can be improved more effectively.

The coagulation condition is to pass the spun fibers through the coagulation bath in which is equipped a funnel-shaped conduit satisfying the following formula (I):

$$1{,}200 \leqq Re = Du\rho/\mu \leqq 6{,}000 \quad \text{(I)}$$

wherein Re represents the Reynold's number, D the inner diameter of the conduit, u the speed of the coagulation liquid, $\rho$ the density of the coagulation liquid, and $\mu$ the viscosity of the coagulation liquid.

When Re is beyond the lower limit, the air dissolved in the spinning solution rises in the funnel-shaped conduit, and is liable to cause variations of the coagulation liquid surface or immersion of the spinneret. When Re exceeds the upper limit, the turbulence in the funnel-shaped conduit disturbs the fibers flowing down through the conduit, and this disturbance spreads to the surface of the coagulation bath liquid, thus causing agglutination and denier fluctuation.

The stretching condition is to conduct stretching under the condition satisfying the following formulas (II) and (III):

$$2 \leqq JS \leqq 20 \quad \text{(II)}$$

$$0.2 \leqq \log JS/\log TS \leqq 0.7 \quad \text{(III)}$$

wherein JS represents jet stretch ratio and TS represents total stretch ratio.

When these conditions are below the lower limit of the formulas (II) and (III), the tension imposed on the liquid fibers is small, so that agglutination is liable to take place under the influence of a slight movement of the coagulation liquid or the flow state in the coagulation liquid. Especially when the stretching condition is below of the lower limit of the formula (III), the smoothness of the surface of the finally obtained fibers is lowered, and therefore it becomes impossible to produce acrylic fibers having animal hair-like touch. When the stretching condition exceeds the upper limit of this range, the surface of the coagulation liquid becomes unstable, and deformation or unevenness of the fibers takes place such as unevenness of the thickness in the fiber axis direction, denier fluctuation, etc.

Water-washing, heat treatment, drying, etc. can be conducted in the usual way.

By using the spinneret of this invention, even if the number of the spinning orifices is increased, the fiber bundle is spun in a tubular form and the coagulation liquid flows easily into the inner part of the fiber bundle from the non-perforated part. It is considered, therefore, that uniform coagulation can be performed and the productivity can be heightened without causing any problems in quality.

EXAMPLES OF THE PRACTICE OF THE INVENTION

This invention will be explained in detail by the following examples. Parts and percentages in the examples are by weight unless otherwise indicated.

Example 1

An AN polymer consisting of 91 parts AN, 9 parts methyl acrylate and 0.4 part sodium allylsulfonate, was dissolved in an aqueous sodium thiocyanate solution of 50% concentration to produce a spinning solution having a polymer concentration of 20% and a viscosity at 30° C. of 4,000 poises.

This spinning solution was dry-wet spun (gap: 5 mm) using an annular spinneret having one non-perforated part of an area ratio of 1/6 (orifice diameter 0.19 mm; orifice interval 1.6 mm; width of the annulus 67 mm; number of orifices 16,000). The fibers were introduced into an aqueous 20% sodium thiocyanate solution of 10° C. in which was equipped a funnel-shaped conduit (inner diameter 120 mm; flow rate of the coagulation liquid 50 liters/min.), to coagulate the fibers. The fibers were subjected to cold-stretching, water-washing and heat stretching (JS ratio 8, TS ratio 40), followed by steam heat treatment and drying treatment. In this way, Fiber (1) of a single filament denier of 3 d was produced.

For comparison, Fiber (2) and Fiber (3) were produced in the same way as above except using an annular spinneret without any non-perforated part and an annular spinneret having two non-perforated parts (each of the area ratio: 1/12) at diametrical positions.

The operability of the production of these fibers and their quality were evaluated. The results are shown in Table 1.

TABLE 1

| No. | 1 | 2 | 3 |
|---|---|---|---|
| Frequency of spinneret immersion | None | high | medium |
| Agglutination (%) | Less than 0.05 | 5–10 | 1–5 |
| Percent denier fluctuation (%) | 1–3 | more than 50 | 20–50 |

From the above Table, it is understood that this invention can produce acrylic fibers of uniform and high quality without problems in operation.

Example 2

Nine kinds of fibers were produced according to Example 1 (No. 1) except changing the inner diameter of the funnel-shaped conduit and the flow rate of the coagulation liquid.

The results of the evaluation of these fibers are shown in Table 2.

TABLE 2

| No. | 4 | 5 | 6 | 7 | 8 | 9 | 10 | 11 | 12 |
|---|---|---|---|---|---|---|---|---|---|
| Inner diameter (mm) | 80 | → | → | 120 | → | → | 160 | → | → |
| Flow rate (lt/min) | 30 | 70 | 110 | 30 | 70 | 110 | 30 | 70 | 110 |
| Re | 2190 | 5110 | 8030 | 1460 | 3410 | 5350 | 1090 | 2550 | 4010 |
| Frequency of spinneret immersion | no | no | no | low | no | no | high | no | no |
| Agglutination (%) | 0.05 and less | 0.1 and less | 1–3 | 0.05 and less | 0.05 and less | 0.1 and less | 0.05 and less | 0.05 and less | 0.05 and less |
| Denier fluctuation (%) | 1–3 | 3–5 | 10–20 | 1–3 | 1–3 | 3–5 | 1–3 | 1–3 | 1–3 |

From the above Table, it is understood that this invention is excellent in both operability and quality, whereas when Re is outside of the recommended range of this invention, there are problems in operability and quality.

Example 3

Eight kinds of fibers were produced according to Example 2 (No. 8) except changing the stretching condition.

The results are shown in Table 3.

TABLE 3

| No. | 13 | 14 | 15 | 16 | 17 | 18 | 19 | 20 |
|---|---|---|---|---|---|---|---|---|
| JS (ratio) | 20.4 | 16.3 | 8.2 | 5.8 | 8.2 | 4.9 | 2.5 | 1.7 |
| TS (ratio) | 81.7 | → | → | → | 24.5 | → | → | → |
| logJS/logTS | 0.69 | 0.63 | 0.48 | 0.40 | 0.66 | 0.5 | 0.28 | 0.17 |
| Denier | 1.5 | → | → | → | 5 | → | → | → |
| Agglutination (%) | 0.05 and less | → | → | → | → | → | → | 2–5 |
| Denier fluctuation (%) | 5–10 | 1–5 | 1–3 | → | → | → | → | → |

As apparent from the above Table, when employing the stretching condition recommended in this invention, there is no problem in quality, but in the case of JS>20 (No. 13), the denier fluctuation tends to increase, and in the case of JS<2 (No. 20), there is a tendency of agglutination.

What we claim is:

1. A method of producing acrylic fibers which comprises:

dry-wet spinning an acrylonitrile polymer spinning solution through an annular type spinneret having a perforated part with more than 3,000 spinning orifices and further having one non-perforated part with no spinning orifices extending from the outer periphery to the inner periphery of the spinneret, wherein the non-perforated part has an area in the range of from 1/9 to 1/5 of the perforatable area of the spinneret, and wherein the spinneret has an annulus and an interval between the spinning orifices which satisfy the following formula (IV):

$$W/p \leqq 100 \quad \text{(IV)}$$

wherein W represents the width of the annulus and p represents the interval between the spinning orifices;

passing the spun fibers through a coagulation bath of a coagulation liquid and having therein a funnel-shaped conduit which satisfies the following formula (I):

$$1{,}200 \leqq Re = Dup/\mu \leqq 6{,}000 \quad \text{(I)}$$

wherein Re represents the Reynold's number of the coagulation liquid, D represents the inner diameter of the conduit, U represents the speed of the coagulation liquid in the conduit, $\sigma$ represents the density of the coagulation liquid and $\mu$ represents the viscosity of the coagulation liquid; and stretching the fibers under conditions which satisfy the following formulas (II) and (III):

$$2 \leqq JS \leqq 20 \quad \text{(II)}$$

$$0.2 \leqq \log JS/\log TS \leqq 0.7 \quad \text{(III)}$$

wherein JS represents a jet stretch ratio and TS represents a total stretch ratio.

* * * * *